US005615844A

United States Patent [19]

Bosch

[11] Patent Number: 5,615,844

[45] Date of Patent: Apr. 1, 1997

[54] CONSTRUCTION AND SPORT LINE REEL

[76] Inventor: Thomas L. Bosch, 1621 Road 80, Pasco, Wash. 99301

[21] Appl. No.: 572,506

[22] Filed: Dec. 14, 1995

[51] Int. Cl.[6] ..... B65H 75/40

[52] U.S. Cl. ..... 242/395; 242/396.5; 242/397; 242/396.9; 242/405.3

[58] Field of Search ..... 242/395, 395.1, 242/396.5, 396.9, 397, 397.3, 402, 405.3

[56] References Cited

U.S. PATENT DOCUMENTS

| | | | |
|---|---|---|---|
| 2,106,053 | 1/1938 | Laingor | 242/396.5 |
| 2,268,178 | 12/1941 | Boisture | 242/395.1 |
| 2,398,805 | 4/1946 | Pomeroy | 242/397 |
| 2,406,874 | 9/1946 | Walker | 242/395 |
| 2,414,169 | 1/1947 | Raymond | 242/396.5 |
| 2,662,700 | 12/1953 | Higgins | 242/396.5 |
| 3,311,319 | 3/1967 | Campbell | 242/395.1 |
| 3,438,595 | 4/1969 | Brown et al. | 242/395 |
| 4,272,036 | 6/1981 | Watermann | 242/395.1 |
| 4,285,477 | 8/1981 | Oxendahl . | |
| 4,596,365 | 6/1986 | Wang | 242/397 |
| 4,813,625 | 3/1989 | Takeda | 242/405.3 |

*Primary Examiner*—John M. Jillions
*Attorney, Agent, or Firm*—Floyd E. Ivey

[57] ABSTRACT

The present invention relates generally to construction line reels used in building construction for layout of true lines between two points and relates in particular to a construction line reel which accommodates more than one gauge of line, which permits line tension control as a means of precluding line tangling and twisting and spool or reel backlash as release or reeling in occurs, permits reeled in line to form tightly and evenly on the spool, increases the ease and speed of reeling in line providing a construction line reel configuration which is easy to hold and control and which may be stored in a nail pouch or coveralls or hooked to a tool belt. This invention also relates to kite flying and will provide storage and control of kite string and control of kites.

11 Claims, 10 Drawing Sheets

CONSTRUCTION AND SPORT LINE REEL

FIELD OF THE INVENTION

The present invention relates generally to construction line reels used in building construction for layout of true lines between two points and relates in particular to improvements over existing construction line reels permitting the use of different gauges of string, the avoidance of string becoming tangled and twisted upon being reeled in, and in particular the ease of reeling in string while allowing the twine to return to the reel in a tight and even formation. This invention also relates to kite flying and will provide storage and control of kite string.

BACKGROUND OF THE INVENTION

Construction line or string is used by construction workers to layout true and straight lines between two points. Such lines are necessary to properly aline structural members. The particular needs for construction line are addressed in U.S. Pat. No. 4,285,477 to Oxendahl which is identified herein as related art and disclosed in accordance with 37 CFR 1.97. Obstacles not addressed by known prior art include 1. need for a construction line reel to accommodate more than one gauge of line, 2. to permit tension control as a principal means of precluding line tangling and twisting and spool or reel backlash as line is released and as it is reeled in, 3. to permit the reeled in line to form on the reel tightly and evenly, 4. to increase the ease and speed of reeling in line, 5. to provide a construction line reel configuration which is easy to hold and control and 6. which fits with ease in a craftsman's nail pouch or coveralls or hang as well from a craftsman's tool belt.

Control of release and reeling in of construction line on prior art reels frequently requires the use of both hands of a construction worker. The construction worker often is positioned in a structure wherein safety requires the worker to maintain a handhold on some element of the structure in order to insure stability. Thus the minimum time during which dedication of both of a construction worker's hands to operation of a construction line reel will increase the likelihood of the worker continuing operation in a safe manner. Likewise, a construction worker's need to maintain a handhold may preclude the ability to utilize a construction line reel requiring the use of both hands.

Kite flying enthusiasts will also recognize problems related in particular to the reeling in of line. Line generally must be hand guided onto a reel to insure its tight and even restoration to the reel. This aspect of the present disclosure is of important interest in construction work as well.

The disclosure herein addresses the ability to employ differing gauges of line, the need of control in releasing and reeling in line, of maintaining tension in line during reeling in to insure tight and even restoration to the reel, of increasing the ease and speed of reeling in line, to provide a configuration which is easy to hold and control and to contain within easy reach of the craftsman.

SUMMARY OF THE INVENTION

In accordance with the present invention, an improved construction and sport line reel is disclosed. The preferred embodiment of the invention facilitates the inhibition of or drag on spool rotation lessening line backlash during line release. The drag or inhibition is provided herein by the spring loading of the spool. This control of or braking of the spool movement both prevents the reel from releasing more line than is intended and prevents the reel or spool from unintended reverse rotation resulting in line backlash and tangling. Such control is exerted in other construction line reels by the construction worker's employment of one hand on the construction reel and the other hand on the line. The means of spool rotation control herein disclosed is through the spring loading of the spool against bearing surfaces between the mainframe and the spool.

Also disclosed by this invention is the means to enable tight and even restoration of the line to the reel upon reeling in the line following use. Control of line restoration to the spool, to insure tight and even layers of line and to prevent twisting, unevenness and overlaying of line rows, is accomplished with other construction line reels by the construction worker's employment of one hand on the construction reel and the other hand guiding the line onto the spool. The improved means of control of line restoration to the spool herein disclosed is through the maintenance of line tension between a line guide means, shown herein as a mainframe line slot, and the spool by the combination of the inhibition of spool rotation, via the spring loading of the spool, and of pressure exerted against the line as it passes through the mainframe line slot via tension means including, as shown herein, a spring loaded ball which may be formed of many rigid and semi-rigid materials including but not limited to a steel ball, other metals, plastics, glass, nylon, teflon and compressed felt in shapes including, but not limited to, spherical, as shown herein. This combination causes the line between the spool and mainframe line slot to remain taut both as line is released and as line is reeled in and in particular as line is reeled in. The resulting tension in the line, particularly as the line is reeled in, performs three significant functions as follows: first, it increases the likelihood that the line will form in uniform alternating rows across the spool throat and lessen the likelihood that the line will form unevenly resulting in uneven filling of the spool throat; second, it decreases the likelihood that a portion of the line will become buried or jammed under line strands thereby interfering with the next line release or deployment; and third, and importantly, the tension created in the line between the spool and the mainframe line slot enables the loading of the maximum amount of line on the spool with the loading otherwise severely diminished in relation to the maximum capacity.

An additional feature of the invention which attributes to the orderly restoration of line to the spool resides in the present disclosure of the dimensions required of the spool throat taper. Spool dimensions are critical in increasing the likelihood of line forming in uniform alternating rows, lessening the likelihood that the line will form unevenly, and decreasing the likelihood that a portion of the line will become buried or jammed. A spool diameter of 4 ⅛" with a ½" spool shaft will require a spool throat taper, designated herein as A°, from spool shaft upwardly, from 15/16" to ⅞" when using #18 twisted or braided string. If the width at the upwardly most dimension of the spool throat taper is greater than 1 ⅛" the string will not be controlled in restoration to the spool resulting in line becoming buried and jammed.

An additional feature which attributes to the orderly restoration of line to the spool is provided by a leveler which is a protrusion from the mainframe toward and even with the spool throat. The leveler contacts line as the spool throat is almost completely filled and acts to direct the line in forming orderly and level across the spool throat.

An additional disclosure herein is improved means of reeling in line by use of an increased ratio gear assembly such that each turn of the crank arm results in the spool rotating more than one turn. The gear assembly permits increased speed in reeling in line upon completion of the use of construction line thereby more rapidly allowing conclusion of the particular work segment being attended to by the craftsman.

The disclosure also demonstrates an improved construction and sport line reel configuration with a mainframe, a handle means shown herein as a mainframe handle integral to the mainframe and a crank arm in communication with the spool via the gear assembly, pinion gear shaft and spool shaft. The mainframe handle may be oriented orthogonally to the mainframe. The orthogonal mainframe handle configuration better enables the craftsman in control of both line release and reeling in. The orthogonal configuration permits the release of construction line by one hand operation. The mainframe, spool with spool biasing means including a spool biasing spring, and line tension provided by a line tension bearing assembly configuration provides a safety factor during reeling in, not provided by prior art, by the partial self-directing, assisted by a leveler, of the orderly restoration of line to the spool. This aspect of the disclosure reduces or eliminates the requirement that the worker separately direct restoration by hand as required by prior art devices. The improved construction disclosed also accommodates ease of storage in a craftsman's nail pouch or coveralls and is thus readily maintained within reach.

This disclosure will also provide additional control over release and reeling in of line or string when used by individuals in flying kites. Different gauges of line or string may be placed on the spool. The improvements described for both release and reeling in will apply as well to kite and other sport applications. The mainframe and spool configuration for kite use will allow the use of 20, 40, 60, 70, 80 and 85 lb. kite string. Due to the smaller gauge string the spool will accommodate up to 700 feet of line. The Line Tensioning Spring Control Screw will permit tension adjustment as required by kite size and wind pressure. This feature will allow a kite to be deployed with ease. This tension adjustment will also improve the ease of reeling in and management of restoration of the line to the spool whether the kite is remaining in the air or on the ground when reeling in occurs.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

The Construction and Sport Line Reel of FIG. 1, 3, 10, and 15 illustrate the invention disclosed herein and is the preferred embodiment wherein a construction and sport line reel 1 is composed of a frame means including, as shown herein, a mainframe 1A having a mainframe 1st and 2nd side 1B, 1C, a mainframe 1st and 2nd end 1D, 1E and a mainframe 1st and 2nd edge 1F, 1G. A mainframe axis 1H bisects the mainframe 1A through the center of the mainframe 1st and 2nd end 1D, 1E and paralleling the mainframe 1st and 2nd edges 1F, 1G. A mainframe transverse axis 1I is orthogonal to the mainframe axis 1H penetrating the mainframe 1A structure from the mainframe 1st edge to the mainframe 2nd edge 1F, 1G proximal to the mainframe 2nd end 1E.

Figure 1:
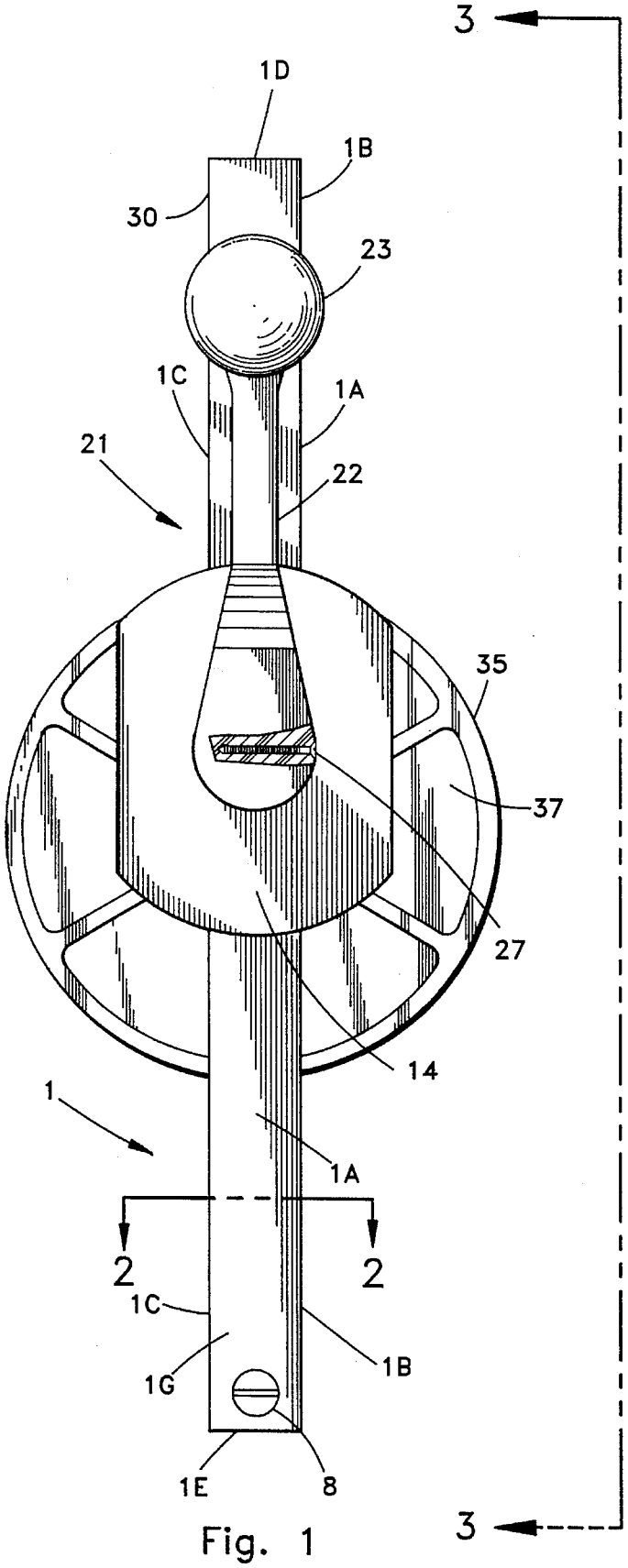
FIG. 1 is an elevation view of the Construction and Sport Line Reel.
Figure 2:
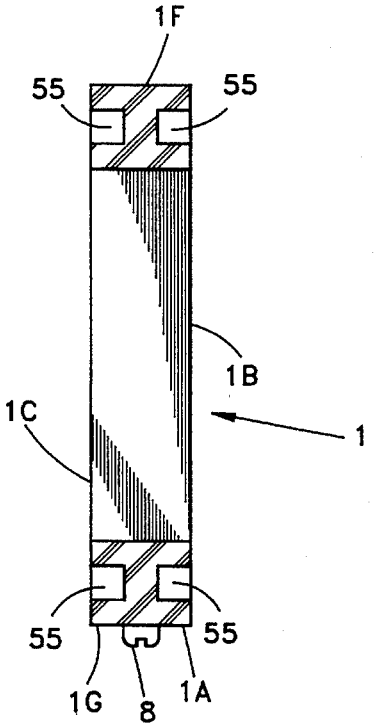
FIG. 2 is a cross section view 2—2 of FIG. 1 showing the cross section of the mainframe of the Construction and Sport Line Reel as expected when formed in an injection molding process.
Figure 3:
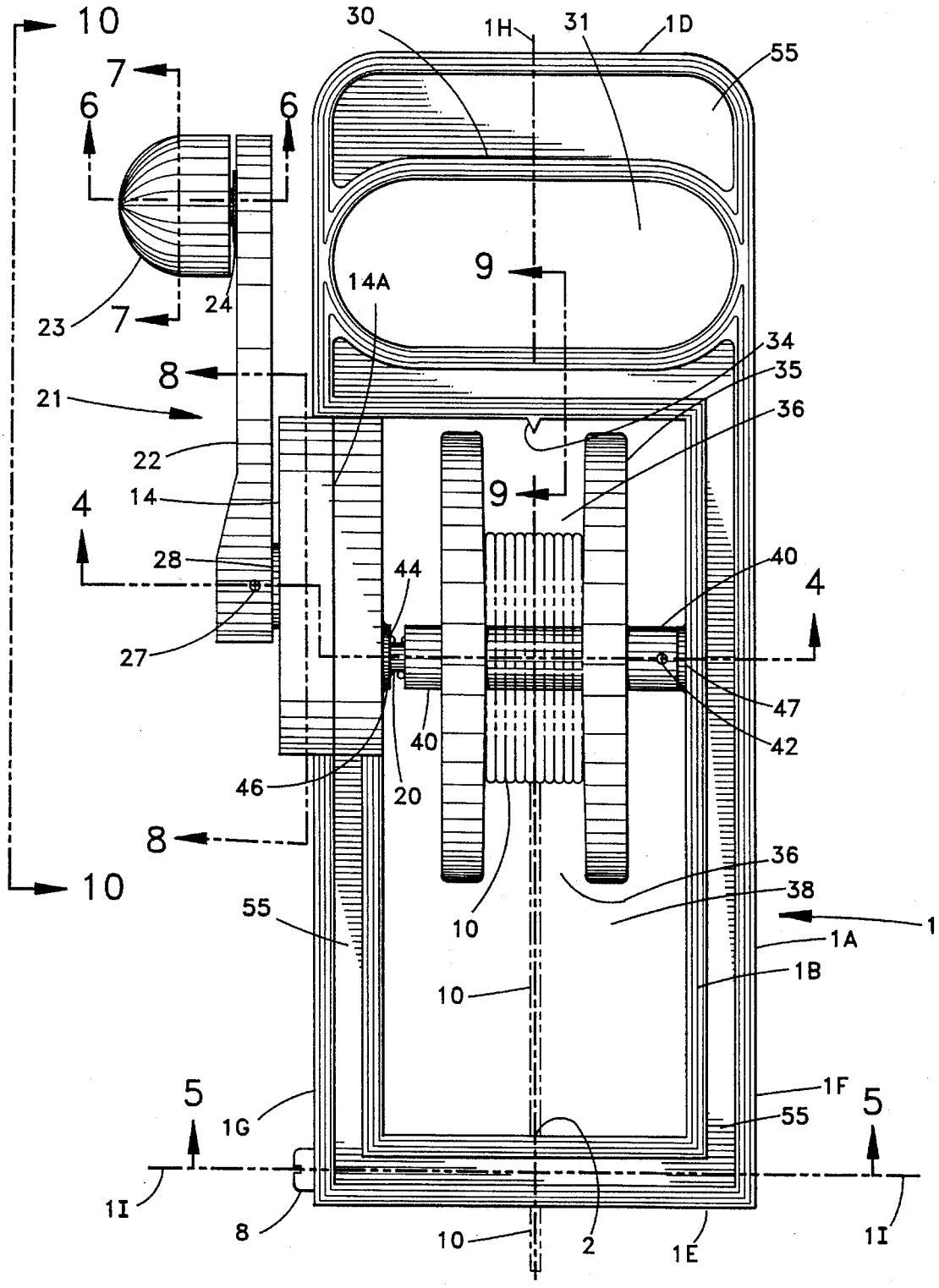
FIG. 3 is a plan view of the Construction and Sport Line Reel.
Figure 5:
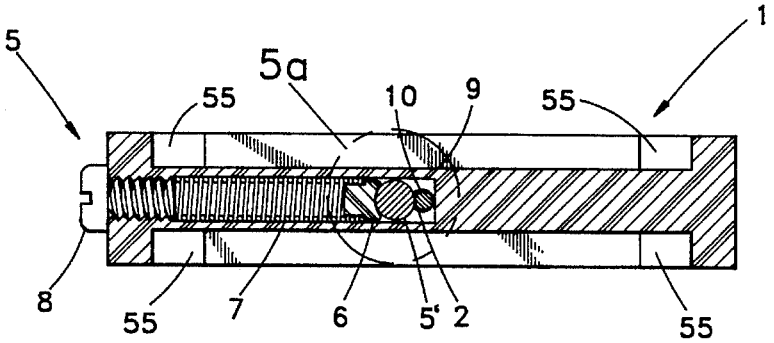
FIG. 5 is a cross section view 5—5 of FIG. 3 and 13 showing the cross section of the line tensioning bearing assembly.
Figure 5A:
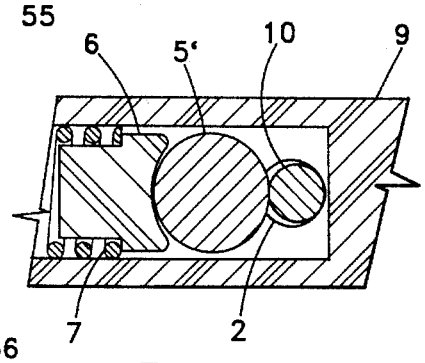
FIG. 5*a* is an enlarged view of a portion of the line tensioning bearing assembly.

A line 10 guide means shown herein as a mainframe line slot 2 penetrates the mainframe 2nd end 1E along the mainframe axis 1H and is shown in FIG. 5 and 5*a*. Tension means will cause tension in a line 10 extending from the spool 35 into and through the mainframe line slot 2. Line tensioning means, shown in FIG. 5, 5*a* and 10, includes: a line tensioning bearing assembly bore 9 received into the mainframe 1A structure from the mainframe 2nd edge 1G proximal to the mainframe 2nd end 1E along the mainframe transverse axis 1I. The line tensioning bearing assembly bore 9 terminates at and penetrates the mainframe line slot 2. A line tensioning bearing assembly 5 is housed in the line tensioning bearing assembly bore 9 consisting of, in order from the mainframe line slot 2 and progressing to the mainframe 2nd edge 1G, a line tensioning steel ball 5' a line tensioning bearing washer 6, a line tensioning spring 7, and a line tensioning spring control screw 8. Said line tensioning bearing assembly 5, by adjustment of the line tensioning spring control screw 8, increases or decreases the compression of the line tensioning spring 7 which forces the line tensioning bearing washer 6 against the line tensioning steel ball 5' into the mainframe line slot 2 and against the string, twine or line 10 passing through the mainframe line slot 2.

Figure 8:
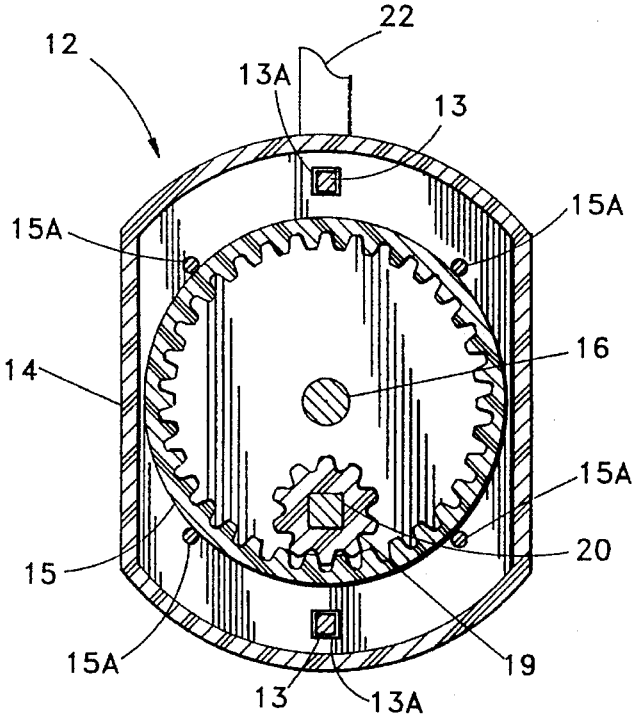
FIG. 8 is a section view 8—8 of FIG. 3 and 13 of one embodiment of the gears showing an improved means of reeling in line with an increased ratio gear assembly.
Figure 10:
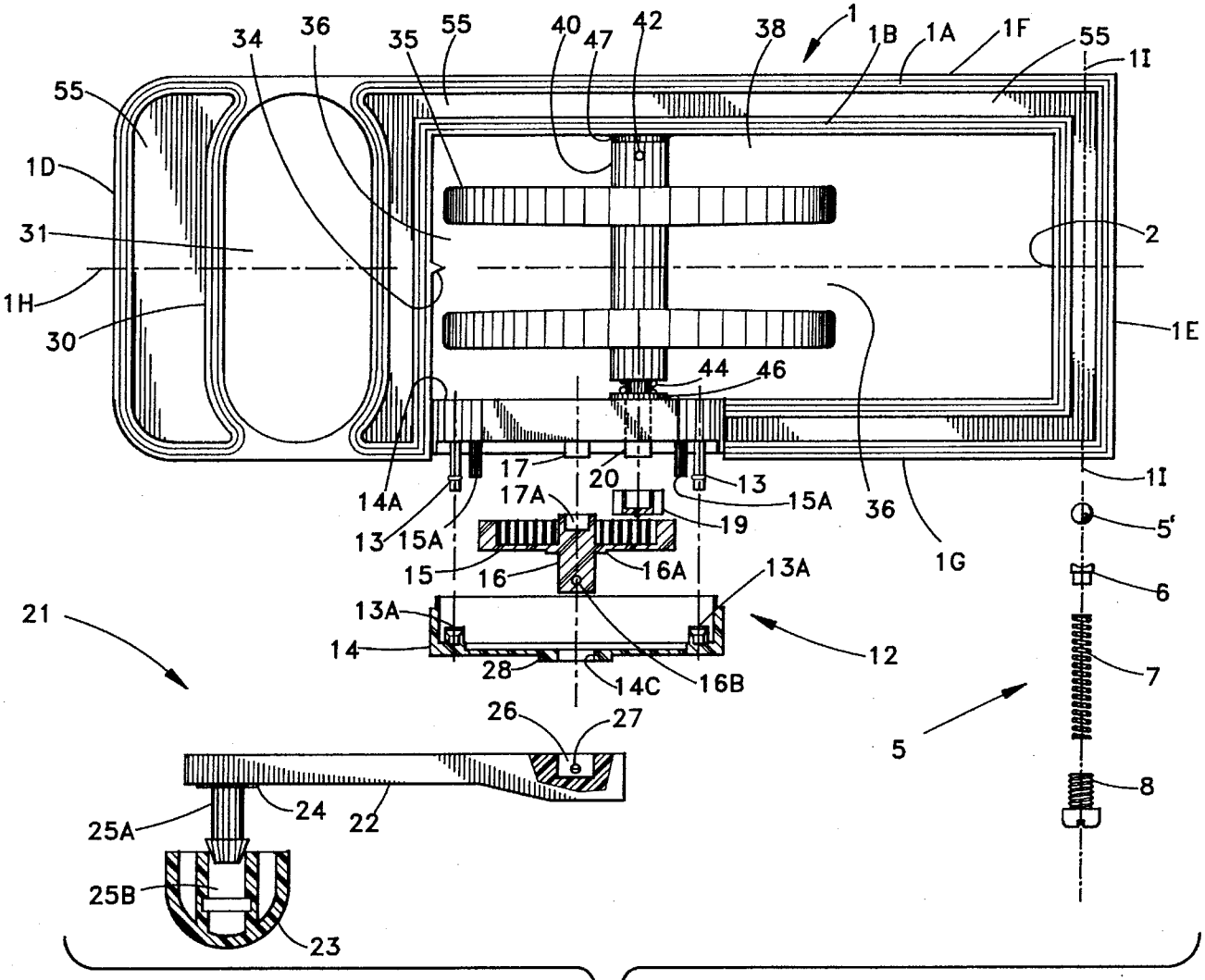
FIG. 10 is an exploded cross section view 10—10 of FIG. 3 of the crank arm assembly and the gear assembly, an exploded view of the line tensioning bearing assembly and a plan view of the mainframe and spool of the Construction and Sport Line Reel of FIG. 3.
Figure 11:
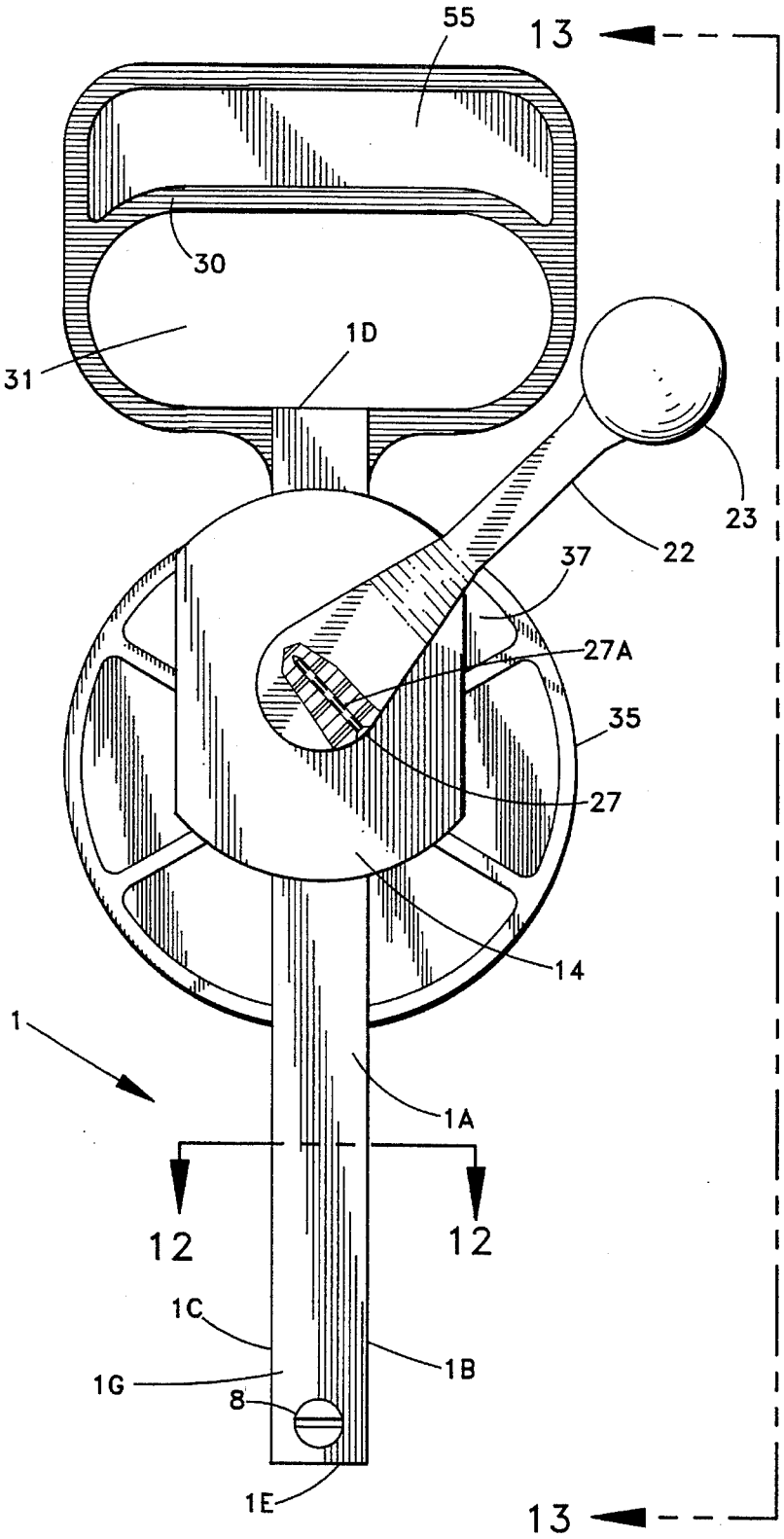
FIG. 11 is an elevation view of the Construction and Sport Line Reel with orthogonal mainframe handle.
Figure 12:
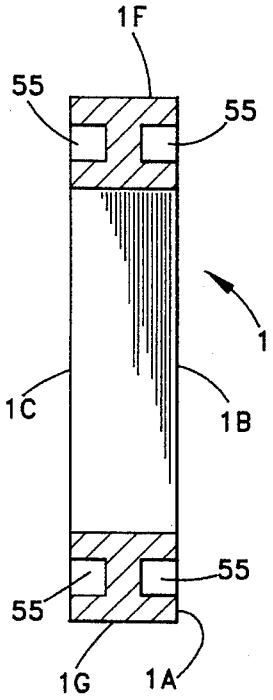
FIG. 12 is a cross section view 12—12 of FIG. 11 showing the cross section of the orthogonal mainframe of the Construction and Sport Line Reel as expected when formed in an injection molding process.
Figure 13:
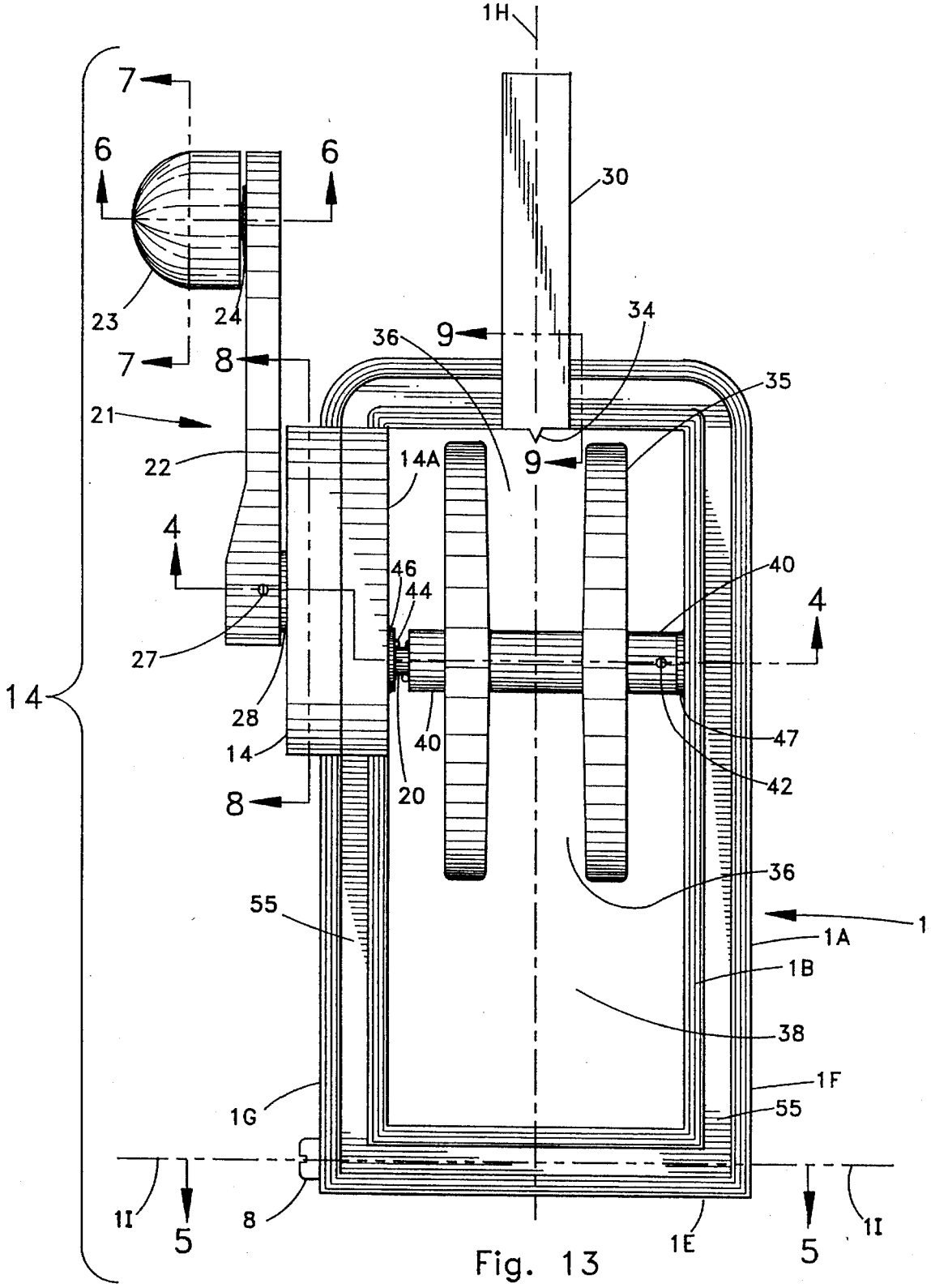
FIG. 13 is a plan view of the Construction and Sport Line Reel with orthogonal mainframe handle.
Figure 14:
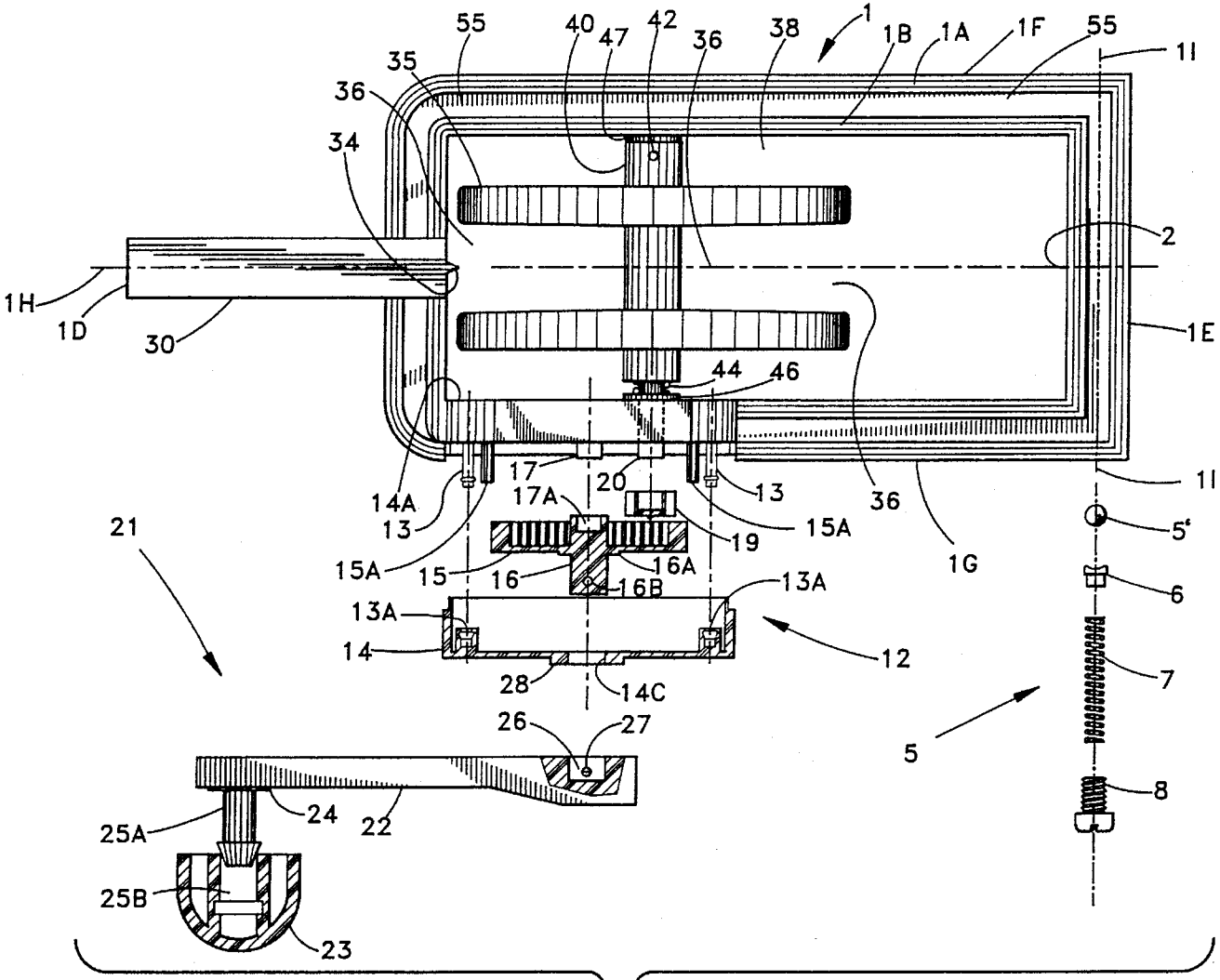
FIG. 14 is an exploded cross section view 14—14 of FIG. 13 of the crank arm assembly and the gear assembly, an exploded view of the line tensioning bearing assembly and a plan view of the mainframe and spool of the Construction and Sport Line Reel with orthogonal mainframe handle.
Figure 15:
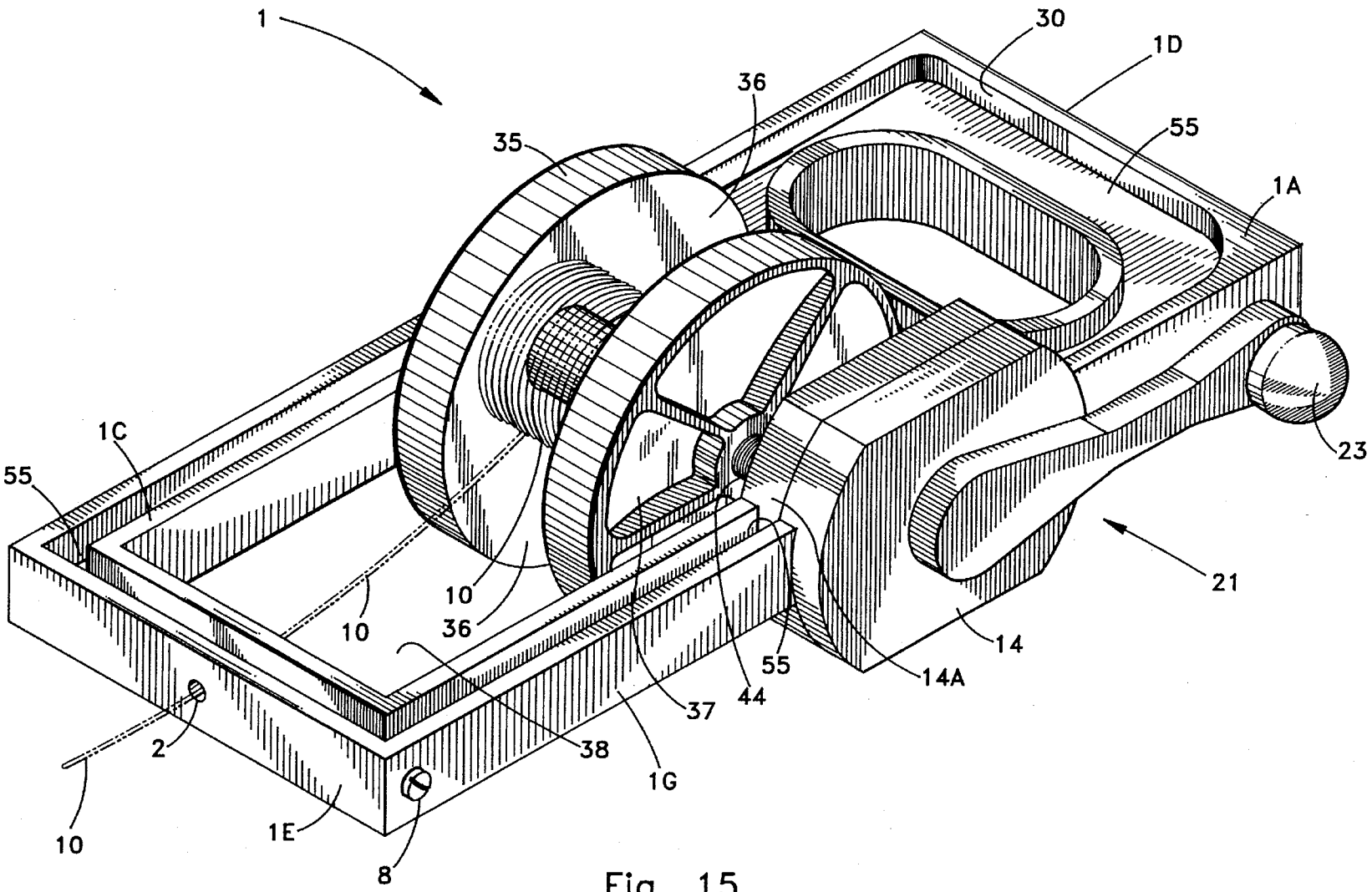
FIG. 15 is a perspective view of the Construction and Sport Line Reel.
Figure 16:
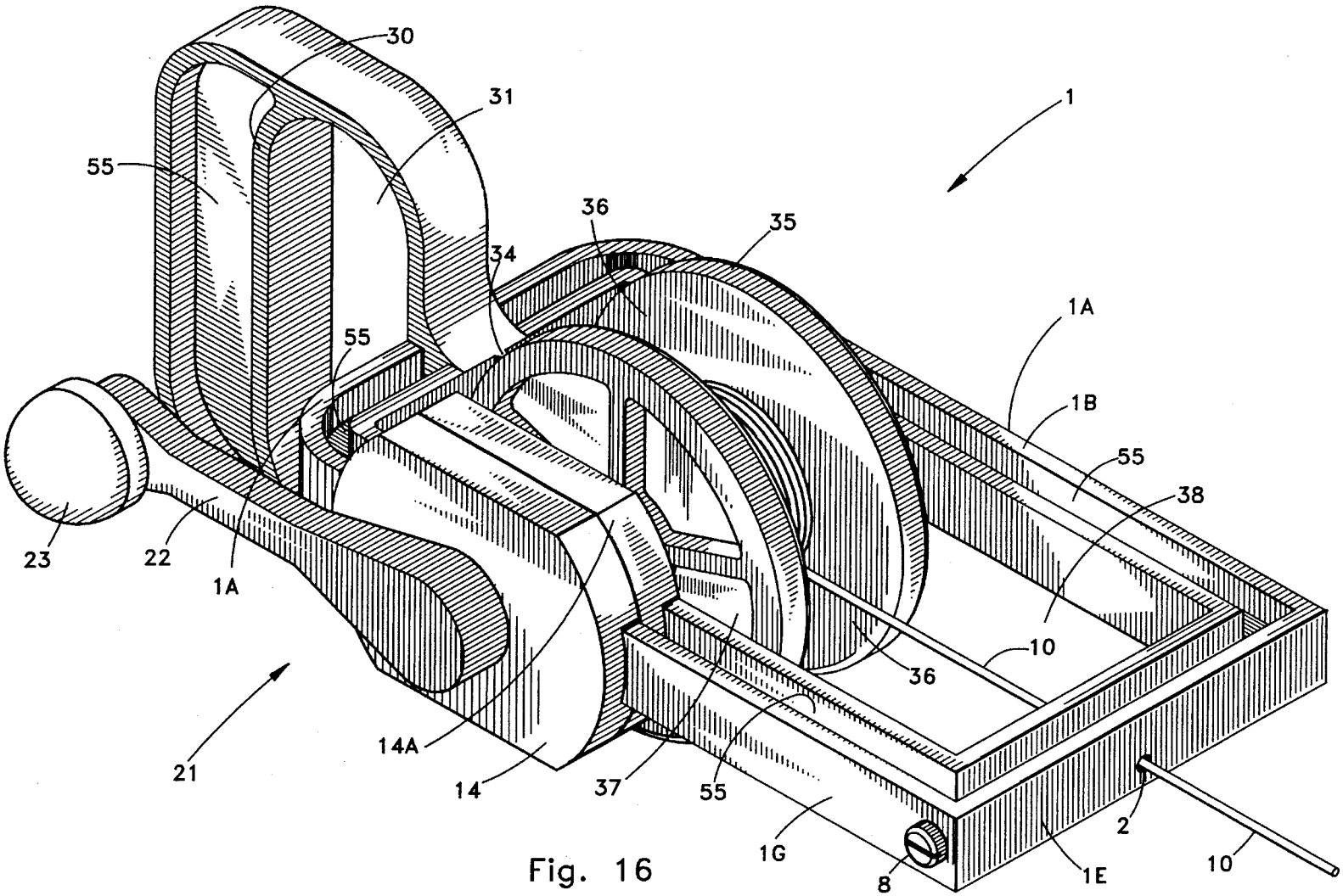
FIG. 16 is a perspective view of the Construction and Sport Line Reel with the handle orthogonally positioned.

A gear means, preferably providing an increased gear ratio, and enclosure, provided herein and shown in FIG. 1, 3, 4, 8, 10, 11 and 14, by a gear assembly 12 composed of a gear assembly cover 14 having a gear assembly cover aperture 14C therein with the gear assembly cover 14 formed to meet a gear assembly base 14A for the purpose of encompassing and protecting the gears contained within the gear assembly 12. The gear assembly cover 14 is affixed to the gear assembly base 14A by means including as shown herein at least one or a plurality of gear assembly cover bosses and boss receivers 13, 13A with the means including but not limited to injection molding and screw means. The preferred embodiment of the gear assembly 12 will provide an increased gear ratio and be composed of large gear 15 and a pinion gear 19. Means including shaft means and guide means will maintain the large gear 15 in mechanical communication with the pinion gear 19 and may include one or both of a mainframe large gear alignment shaft 17 affixed to the gear assembly base 14A and received into a large gear shaft alignment shaft bore 17A which is formed into the large gear 15 and a plurality of guide pins 15A which may, in the example as shown in FIG. 8, 10 and 14, protrude from the gear assembly base 14A to be in close proximity to the circumference of the large gear 15 thus restraining lateral movement and encouraging the large gear 15 to solely revolve around the large gear alignment shaft 17 providing stability to the mechanical relation of the large gear 15 and the pinion gear 19; a large gear shaft 16 having a bore therein as a large gear shaft set screw bore 16B therein is affixed to the large gear 15 in a position aligned with and opposed to the large gear shaft alignment shaft bore 17A; a pinion gear shaft 20 is received into a spool pinion gear shaft bore 41 which penetrates the mainframe 1A from the gear assembly base 14A parallel to the mainframe transverse axis 1I through a spool shaft 40 terminating in the mainframe 1A structure proximal to the mainframe 1st edge 1F. The disclosure herein of gear means and shaft means is principally for the purpose of locating the pinion gear shaft 20. The pinion gear shaft 20 or other shaft means located in accordance with the description of the pinion gear shaft 20 in turn determines the location and orientation of a spool 35 which will contain the line or string and which in turn enables a primary function of this invention.

The gear means, provided for example by the gear assembly 12, is operated or turned by a crank means which is provided as an example in the preferred embodiment by a crank arm assembly 21 comprised of a crank arm 22 having therein a crank arm shaft bore 26. The large gear shaft 16 is received through the gear assembly cover aperture 14C, through a crank arm spacing boss washer 28 and into the crank arm shaft bore 26 where it is secured from rotation by means including as shown herein a crank arm shaft bore set screw 27 inserted into the large gear shaft 16 and received by the large gear shaft set screw bore 16B via a crank arm shaft bore set screw bore 27A. A large gear shaft bearing 16A occupies the same axis as the large gear shaft 16 and serves as the bearing surface between the large gear 15 and the gear assembly cover 14. The crank arm 22 rotates in relation to the mainframe 1A around the large gear shaft 16, and in this embodiment, essentially parallel to the mainframe 1st edge 1G and the mainframe axis 1H. The crank arm 22 is rotated by a knob means which in this embodiment is composed of a crank arm knob 23, having a crank arm knob clasp receptacle 25B, is affixed to the crank arm 22 by means of a crank arm clasp 25A protruding from the crank arm 22 distally from and opposing the crank arm shaft bore 26 at a location to provide the desired mechanical advantage. The crank arm clasp 25A is received into or accepted by the crank arm knob clasp receptacle 25B and is secured by securing means to the crank arm knob 23 which may include screw means or press fit or friction means. A crank arm knob boss washer 24 is received by the crank arm clasp 25A to provide a bearing surface between the crank arm knob 23 and the crank arm 22.

A handle means shown herein as a mainframe handle 30 is formed by a handle opening 31 penetrating the mainframe 1A from the mainframe 1st to the 2nd side 1B, 1C and proximal to the mainframe 1st end 1D. A spool slot 38 penetrates the mainframe 1A from the mainframe 1st to the 2nd side 1B, 1C, intermediate between the mainframe 1A structure accommodating the line tensioning bearing assembly 5 and the handle opening 31.

Figure 4:
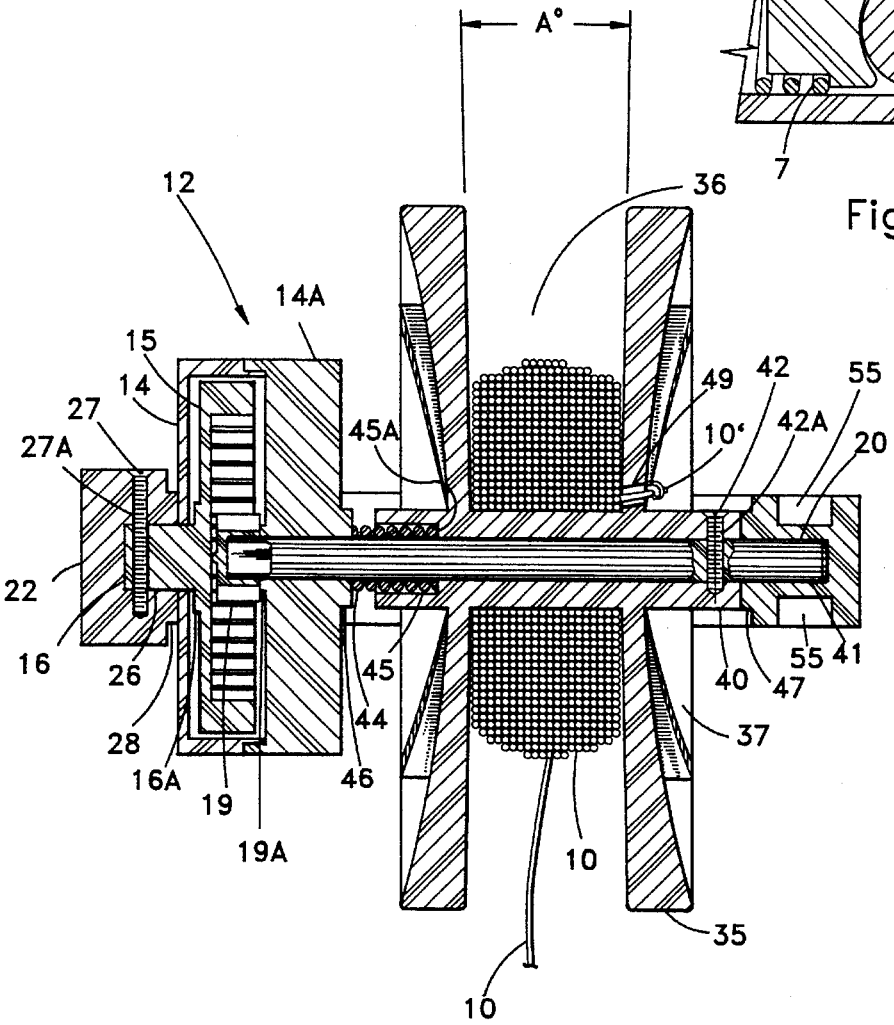
FIG. 4 is a cross section view 4—4 of FIG. 3 and 13 showing the cross section of the mainframe, spool, spool shaft, spool biasing spring, spool biasing spring bearing washer, spool shaft bearing washer and gear assembly.
Figure 6:
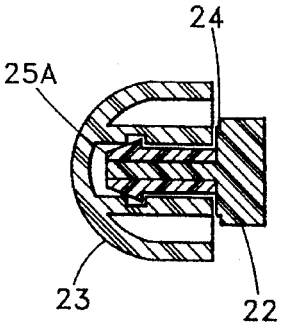
FIG. 6 is a cross section view 6—6 of FIG. 3 and 13 of one embodiment of the crank arm knob, crank arm knob clasp receptacle and crank arm knob clasp as expected when formed in an injection molding process.
Figure 7:
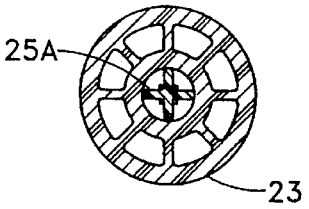
FIG. 7 is a section view 7—7 of FIG. 3 and 13 of one embodiment of the crank arm knob as expected when formed in an injection molding process.
Figure 9:
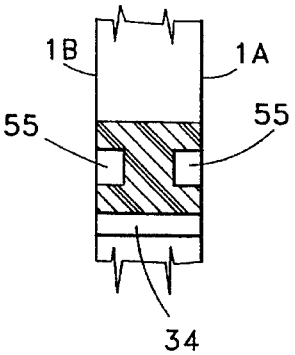
FIG. 9 is a section view 9—9 of FIG. 3 and 13 showing the profile of the line leveler.

Spool means, provided herein by a spool 35 having a spool throat 36, contains the line 10 or string used in this invention and has a spool throat taper A° as shown in FIG. 4. The gear operation of the pinion gear shaft 20, in its mechanical relation with the spool shaft 40, causes the spool 35 to rotate such that line 10 or string positioned within the spool throat 36 is released or reeled in, through the mainframe line slot 2, along a plane approximately parallel with the mainframe axis 1H and orthogonal to the mainframe transverse axis 1I. The spool 35 is secured to the pinion gear shaft 20 by means, to preclude rotation around the pinion gear shaft 20, including in this embodiment by a spool pinion gear shaft pin 42 received into a spool pinion gear shaft pin bore 42A which penetrates the spool shaft 40 and pinion gear shaft 20. A bearing surface means is provided between the spool shaft 40 and the mainframe 1A proximal to the mainframe 1st edge IF which in this embodiment is formed by a spool shaft bearing boss washer 47 and between the spool shaft 40 and the mainframe 1A proximal to the gear assembly base 14A which in this embodiment is formed by a spool biasing spring bearing boss washer 46. A biasing means positioned between the spool shaft 40 and the spool biasing spring bearing boss washer 46 smooths the turning of the spool 35. The biasing means may be provided in this embodiment by a spool biasing spring 44 received into a spool biasing spring bore 45 in the spool shaft 40 with the spool biasing spring bore 45 sharing the axis of the pinion gear shaft 20 and having an inside diameter larger than the diameter of the pinion gear shaft 20 and terminating at a spool biasing spring bore shoulder 45A. The spool biasing spring 44 bears on the spool biasing spring bearing boss washer 46 and terminates against the spool biasing spring bore shoulder 45A.

The Construction and Sport Line Reel may be manufactured from many rigid materials including, but not limited to, plastics, wood, and metal and in the preferred embodiment is produced in a plastic injection molding process wherein injection molding cavities will exist in most components forming this invention including those found in the mainframe in the form of an injection molding cavity 55. Additionally a spool injection molding cavity 37 is formed in the spool 35 proximal to the mainframe 1A and mainframe 1st edge 1F and in the spool 35 proximal to the gear assembly base 14A. Means is provided to anchor the end of the line or string wound in the spool throat 36 and may be provided in this preferred embodiment by a spool line hole 49 extending from the spool throat 36 to the spool injection molding cavity 37 where the line may be secured by means including a knot 10' as shown in FIG. 4. The line or string is guided during the reeling in process by a line leveler 34, shown in FIG. 3, 9, 10, 13 and 14, consisting of a protrusion affixed to the mainframe 1A along the mainframe axis 1H within the spool slot 38 area proximal to a mainframe handle 30 such that last approximately 20 feet of line or string is directed by the line leveler 34 and caused to form evenly across the spool throat 36 at the point when the spool throat 36 is almost filled. Bearing surfaces throughout this disclosure may be provided by bearing means including but not limited to washers, bearing washers, bosses, boss washers and surfaces produced through a plastic injection molding process.

An alternative embodiment of the Construction and Sport Line Reel is depicted in FIG. 11, 13, 14 and 16 which illustrate the invention disclosed herein and is an embodiment wherein a construction and sport line reel 1 has a mainframe handle 30 oriented orthogonally to the mainframe 1A. In this embodiment the mainframe handle 30 has a handle opening 31 through which a workman inserts fingers in order to grasp the invention. The mainframe handle 30, in this orthogonal orientation, is fixed to the mainframe 1A by means which could include screws, bosses or other fastening devices and which may be provided in this embodiment by an injection molding clip arrangement as between the mainframe handle 30 and the mainframe 1st end 1D.

While a preferred embodiment and an alternative embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A construction and sport line reel comprising:

A. a mainframe (1A) having a mainframe first and second side (1B), (1C), a mainframe first and second end (1D), (1E) and a mainframe first and second edge (1F), (1G); a mainframe axis (1H) bisects the mainframe (1A)through the center of the mainframe first and second end (1D), (1E) and paralleling the mainframe first and second edges (1F), (1G); a mainframe transverse axis (1I) is orthogonal to the mainframe axis (1H) penetrating the mainframe (1A) structure from the mainframe first edge to the mainframe second edge (1F), (1G) proximal to the mainframe second end (1E);

B. a mainframe line slot (2) penetrates the mainframe second end (1E) along the mainframe axis (1H); a line tensioning bearing assembly bore (9) is received into the mainframe (1A) structure from the mainframe second edge (16) proximal to the mainframe second end (1E) along the mainframe transverse axis (1H) the line tensioning bearing assembly bore (9) terminates at and penetrates the mainframe line slot (2); a line tensioning bearing assembly (5) is housed in the line tensioning bearing assembly bore (9) consisting of, in order from the mainframe line slot (2)and progressing to the mainframe second edge (1G), a line tensioning steel ball (5'), a line tensioning bearing washer (6), a line tensioning spring (7), and a line tensioning spring control screw (8); said line tensioning bearing assembly (5), by adjustment of the line tensioning spring control screw (8), urges the line tensioning steel ball (5') against and partially into the mainframe line slot (2) and against a lien (10) passing through the mainframe line slot (2);

C. a gear assembly (12) composed of a gear assembly cover (14) having a gear assembly cover aperture (14C) therein with the gear assembly cover (14) formed to meet a gear assembly base (14A) for the purpose of encompassing and protecting the gears contained within the gear assembly (12); the gear assembly cover (14) is affixed to the gear assembly base (14A) by means including at least one gear assembly cover boss (13) and boss receiver (13A); the gear assembly (12) composed of large gear (15) and a pinion gear (19); mechanical communication between the large gear (15) and the pinion gear (19) provided by a mainframe large gear alignment shaft (17) affixed to the gear assembly base (14A) and received into a large gear shaft alignment shaft bore (17A) which is formed into the large gear (15); a large gear shaft (16) is affixed to the large gear (15) in a position aligned with and opposed to the large gear shaft alignment shaft bore (17A); a pinion gear shaft (20) is received into a spool pinion gear shaft bore (41) which penetrates the mainframe (1A) from the gear assembly base (14A) parallel to the mainframe transverse axis (1H) through a spool shaft (40) terminating in the mainframe (1A) structure proximal to the mainframe first edge (1F);

D. a crank arm assembly (21) comprised of a crank arm (22) having therein a crank arm shaft bore (26 ); the large gear shaft (16) is received through the gear assembly cover aperture (14C) through a crank arm spacing boss washer (28) and into the crank arm shaft bore (26) where it is secured from rotation by a crank arm shaft bore set screw (27) inserted into the large gear shaft (16) and received by the large gear shaft set screw bore (16B) via a crank arm shaft bore set screw bore (27A); large gear shaft bearing (16A) occupies the same axis as the large gear shaft (16) and serves as the bearing surface between the large gear (15) and the gear assembly cover (14), the crank arm (22) rotates in relation to the mainframe (1A) around the large gear shaft (16) causing rotation of the large gears (15); a crank arm knob (23), having a crank arm knob clasp receptacle (25B) is affixed to the crank arm (22) by means of a crank arm clasp (25A) protruding from the crank arm (22) distally from and opposing the crank arm shaft bore (26) at a location to provide the desired mechanical advantage; the crank arm clasp (25A) is received into or accepted by the crank arm clasp receptacle (25B) and is secured by securing means to the crank arm knob (23); a crank arm knob boss washer (24) is received by the crank arm clasp (25A) to provide a bearing surface between the crank arm knob (23) band the crank arm (22);

E. a mainframe handled (30) is formed by a handle opening (31) penetrating the mainframe (1A) from the mainframe first to the second side (1B), (1C) and proximal to the mainframe first end (1D);

F. a spool slot (38) penetrates the mainframe (1A) from the mainframe first to the second side; (1B), (1C) intermediate the mainframe (1A) structure accommodating the line tensioning bearing assembly (5) and the handle opening (31); a spool (35) has a pool throat (36) which contains the line (10) or string; the gear operation of the pinion gear shaft (20), in its mechanical relation with the spool shaft, causes the spool (35) to rotate such that line (10) or string positioned within the spool throat (36) is released or reeled in, through the mainframe line slot (2), along a plane approximately parallel with the mainframe axis (1H) and orthogonal to the mainframe transverse axis: (1H); the spool (35) is secured to the pinion gear shaft (20) by a spool pinion gear shaft pin (42) received into a spool pinion gear shaft pin bore (42A) which penetrates the spool shaft (40) and pinion gear shaft (20); a bearing surface is provided between the spool shaft (40) and the mainframe (1A) lab proximal to the mainframe first edge (1F) which is formed by a spool shaft bearing boss washer (47) and between the spool shaft (40) and the mainframe (1A) proximal to the gear assembly base (14A) which is formed by a spool biasing spring bearing boss washer (46); a biasing means positioned between the spool shaft (40) and the spool biasing spring bearing boss washer (46) provided by a spool biasing spring (44) received into a spool biasing spring bore (45) in the spool shaft (40) with the spool biasing spring bore (45) sharing the axis of the pinion gear shaft (20) and having an inside diameter larger than the diameter of the pinion gear shaft (20) and terminating at a spool biasing spring bore shoulder (45A); the spool biasing spring (44) bears on the spool biasing spring bearing boss water (46) and terminates against the spool biasing spring bore shoulder (45A);

G. an injection molding cavity (55); a spool injection molding cavity (37) is formed in the spool (34) proximal to the mainframe (1A) and mainframe first edge (1F) and in the spool (34) proximal to the gear assembly base (14A); a spool line hole (49) extending from the spool throat (36) to the spool injection molding cavity (37) where the line may be secured by a knot (10'); the line or string is guided during the reeling in process by a lien leveler (34) consisting of a protrusion affixed to the mainframe (1A) along the mainframe axis (1H) within the spool slot (38) area proximal to a mainframe handle (30).

2. A construction and sport line reel according to claim 1 constructed from a plastic injection molding process wherein an injection molding cavity (55) is formed in the mainframe (1*a*); a spool injection molding cavity (37) is formed in the spool (34) proximal to the mainframe (1A) and mainframe first edge (1F) and in the spool (34) proximal to the gear assembly base (14A); a spool line hole (49) extending from the spool throat (36) to the spool injection molding cavity (37) where the line (10) secured by a knot (10').

3. A construction and sport line reel according to claim 1 constructed from a rigid material.

4. A construction and sport line reel according to claim 1 wherein:

A. the mainframe handle (30) is oriented orthogonally to the mainframe (1A) and is fixed to the mainframe (1A).

5. A construction and sport line reel according to claim 4 wherein:

A. the gear assembly having an increased gear ratio.

6. A construction and sport line reel according to claim 5 constructed from a plastic injection molding process wherein an injection molding cavity (55) is formed in the mainframe (1*1*); a spool injection molding cavity (37) is formed in the spool (34) proximal to the mainframe (1A ) and mainframe first edge (1F) and in the spool (34) proximal to the gear assembly base (14A); a spool line hole (49) extending from the spool throat (36) to the spool injection molding cavity (37) where the line (10) is secured by a knot (10').

7. A construction and sport line reel according to claim 5 constructed from a rigid material.

8. A construction and sport line reel according to claim 1 wherein:

A. the gear assembly having an increased gear ratio.

9. A construction and sport line reel wherein:

A. a frame means supports a spool means which has a spool throat (36); a spool biasing means restrains backlash movement of the spool means;

B. line (10) is contained in the spool throat (36) and passes from the spool throat (36) through a line guide means in the frame means; line tension means maintains tension in the line (10) between the spool throat (36) and the line guide means providing additional control over and reduction of spool backlash and ease of line (10) release and reeling in and tension in the line (10) during reeling in to enable all line (10) to be returned to the spool throat (36)

C. a gear means is secured by means to the frame means, and includes gears in mechanical communication to cause rotation of a pinion gear shaft (20) which is in mechanical communication with and rotates the spool means; a crank means in mechanical communication with the gear means to permit rotation of the gear means; a line leveler affixed to the frame means which guides the line (10) into the spool throat (36) during reeling in.

10. A construction and sport line reel according to claim 9 constructed from a plastic injection molding process.

11. A construction and sport line reel according to claim 9 constructed from a rigid material.

* * * * *